US008397962B1

(12) United States Patent
O'Connell

(10) Patent No.: US 8,397,962 B1
(45) Date of Patent: Mar. 19, 2013

(54) HYDRATION METHOD EMPLOYING REPLENISHABLE DRINKING VESSEL

(76) Inventor: Thomas P O'Connell, Arlington, MA (US)

( * ) Notice: Subject to any disclaimer, the term of this patent is extended or adjusted under 35 U.S.C. 154(b) by 0 days.

(21) Appl. No.: 12/883,292

(22) Filed: Sep. 16, 2010

Related U.S. Application Data

(63) Continuation of application No. 11/133,704, filed on May 19, 2005, now Pat. No. 7,819,293.

(60) Provisional application No. 60/572,332, filed on May 19, 2004.

(51) Int. Cl.
*A45F 3/20* (2006.01)

(52) U.S. Cl. ..... 224/148.1; 224/148.7

(58) Field of Classification Search ..... 224/148.1, 224/148.2, 148.4, 148.5, 148.6, 148.7, 218; 220/703, 705, 710.5, 720, 907; 215/2; 239/33
See application file for complete search history.

(56) References Cited

U.S. PATENT DOCUMENTS 4,873,100 A * 10/1989 Dirksing et al. ..... 426/111
5,282,557 A * 2/1994 McCook ..... 224/148.2
5,335,851 A * 8/1994 Adaska et al. ..... 239/33
5,361,987 A * 11/1994 Matheussen et al. ..... 239/33
5,582,326 A * 12/1996 Nishimura ..... 221/281
5,667,101 A * 9/1997 Barrash et al. ..... 222/92
5,753,289 A * 5/1998 Ness ..... 426/394
5,890,636 A * 4/1999 Kibbe ..... 224/148.6
6,045,020 A * 4/2000 Rassier et al. ..... 224/414
6,092,647 A * 7/2000 Yeh et al. ..... 206/86
6,666,360 B1 * 12/2003 Swank ..... 224/148.2
2003/0218076 A1 * 11/2003 Farnsworth et al. ..... 239/33

* cited by examiner

*Primary Examiner* — Justin Larson
(74) *Attorney, Agent, or Firm* — O'Connell Law Firm; Thomas P. O'Connell

(57) ABSTRACT

A handheld drinking vessel with a compressible bladder, inlet and outlet members, an inlet valve to allow liquid to flow into the bladder, and an outlet valve to allow liquid to flow from the bladder whereby liquid can be exhausted by a compression of the bladder and liquid can be drawn into the bladder by a decompression of the bladder. The drinking vessel can be employed to provide hydration to athletes during athletic endeavors by providing athletes with drinking vessels and providing at least one water stop with beverage containers. Water can be drawn from a beverage container through the inlet member and consumed through the outlet member. When provided by a sponsor or race organizer, the drinking vessels can be distributed on a complimentary basis filled with a beverage of a purveyor of beverages.

18 Claims, 8 Drawing Sheets

HYDRATION METHOD EMPLOYING REPLENISHABLE DRINKING VESSEL

PRIORITY CLAIM

This application is a continuation of application Ser. No. 11/133,704, filed May 19, 2005, which claims priority to Provisional Patent Application No. 60/572,332, filed May 19, 2004, and which issued as U.S. Pat. No. 7,819,293 B1 on Oct. 26, 2010.

FIELD OF THE INVENTION

The present invention relates generally to drinking vessels. More particularly, disclosed herein is a drinking vessel that can be replenished with liquid contents by hand actuation to provide readily accessible, easily consumed liquid refreshment under widely varied conditions.

BACKGROUND OF THE INVENTION

When seeking to gain liquid refreshment during a road race, runners converge upon what is commonly referred to as a water stop, which essentially comprises a table stacked with filled paper drinking cups. Each runner must grab a cup, take a gulp, and continue running, ideally while breaking stride as little as possible. However, what is a simple task while standing still can be remarkably problematic while running.

Indeed, numerous articles have been directed solely to the topic of how to drink while on the run. Experienced runners often advise novices on how to confront the challenges of drinking during races just as seriously as they advise regarding speed and hill work. Many distance runners actually practice how to drink while running as they seek to minimize the disruption presented by doing so while maximizing their ability to hydrate in race situations.

Nonetheless, smooth and effective drinking eludes most runners. As any racer will be more than well aware, most runners spend more time choking and dropping cups than they do getting the fluid replacement that is so vital to optimal running performance. All too many runners come away from water stations uncontrollably choking instead of smoothly continuing on in the race. Others seek to avoid choking by taking tiny sips, possibly while partially crushing or otherwise manipulating the cup in an attempt to prevent splashing, choking, and the like. Still other runners attempt to provide for their hydration by carrying water bottles along with them, but they are burdened with the weight and awkwardness of the bottles, which often carry too little liquid for long distance racing. Some runners simply resign themselves to walking through water stations to gain effective hydration. In any case, runners gaining their fluid from water stations must drink it all over the course of just a few yards and then do without fluid until the next water station, which might be two or more miles away.

As a result, while distance runners are fully aware that proper hydration is integral to optimal and safe running performance, they are typically left with a choice between running unimpeded or obtaining the required hydration. The runner opting for running unimpeded past water stations will eventually pay as his or her system breaks down for lack of hydration. The runner opting for full hydration will commonly lose time as he or she is slowed by choking, walking, spilling, and still further difficulties.

SUMMARY OF THE INVENTION

Advantageously, the present invention is founded on the basic object of providing a drinking vessel that provides easily consumed, readily replenished, and conveniently accessible liquid refreshment under widely varied conditions.

A related object of embodiments of the invention is to provide a drinking vessel that can enable a runner to run through water stops substantially unimpeded while nonetheless obtaining full and proper hydration thereby to enable a runner to run faster.

Another related object of the invention is to provide a drinking vessel that allows a runner to drink comfortably with substantially no risk of choking.

Yet another object of the invention is to provide a drinking vessel that can be refilled with liquid in a substantially seamless manner during running.

Still another object of the invention is to provide a drinking vessel that can be carried with substantially no inconvenience or discomfort to the user, particularly when the device is empty.

An even further object of the invention is to provide a drinking vessel that makes liquid available to a runner over extended running distances.

These and further objects and advantages of embodiments of the invention will become obvious not only to one who reviews the present specification and drawings but also to one who has an opportunity to make use of an embodiment of the instant invention for a replenishable drinking vessel. However, it will be appreciated that, although the accomplishment of each of the foregoing objects in a single embodiment of the invention may be possible and indeed preferred, not all embodiments will seek or need to accomplish each and every potential object and advantage. Nonetheless, all such embodiments should be considered within the scope of the present invention.

In carrying forth the aforementioned objects, one potential embodiment of the present invention for a handheld, replenishable drinking vessel is founded on a compressible bladder for being received within a hand of a user. The compressible bladder has an open inner volume for retaining a volume of liquid and is compressible between a non-compressed configuration and a compressed configuration. Inlet and outlet members, which can each comprise a tube with a fluid flow path therethrough, can have a proximal end in fluidic association with the compressible bladder and a distal portion. For example, the outlet member can project from an upper portion of the compressible bladder while the inlet member can project from a lower portion of the compressible bladder. An inlet valve arrangement, which can comprise a one-way valve, can be disposed in fluidic association with the compressible bladder and can be configured to permit a flow of liquid into the compressible bladder through the inlet member. An outlet valve arrangement, which can also comprise a one-way valve, a bite valve or other selectively operable valve, or any other suitable type of valve, can be disposed in fluidic association with the outlet member and can be configured to permit a flow of liquid from the compressible bladder through the outlet member.

Under such an arrangement, a volume of liquid can be exhausted from the open inner volume of the compressible bladder through the outlet member by a compression of the compressible bladder. With this, an athlete, such as a runner, can gain liquid refreshment by imparting suction to the outlet member and, additionally or alternatively, by compressing the compressible bladder. When necessary, the open inner volume of the compressible bladder can be replenished with liquid contents simply by an insertion of the inlet member into a volume of liquid, such as a cup of water or sports drink, and a decompressing of the compressible bladder.

Certain embodiments of the drinking vessel can incorporate a means for enabling an exertion of an expansion force on the compressible bladder to enable a user to draw the compressible bladder toward a non-compressed configuration. Numerous means would readily occur to one skilled in the art after reading this disclosure including, for example, knobs, handles, and the like. In one embodiment, the means for enabling an exertion of an expansion force takes the form of first and second straps coupled in spaced relation to the compressible bladder. Each strap can have a free body portion and first and second ends coupled to the compressible bladder.

The compressible bladder can be formed from a flexible material. In certain embodiments, by way of example, the compressible bladder can be formed from a thin film material. A skeleton structure, which can be spring-loaded either to a compressed configuration or a non-compressed configuration, can be engaged with the compressible bladder to bias the compressible bladder to a given configuration. The compressible bladder can, for example, have first and second side walls coupled at proximal portions thereof at an effective axis to pivot thereabout. In such constructions, the skeleton can be V shaped, and a base of the V can be disposed adjacent to the effective axis of the first and second side walls. A collapsible compression wall can span between distal portions of the first and second side walls. The compressible bladder can be compressed to a substantially flat configuration with a pivoting of the first side wall into proximity with the second side wall and a compression of the compression wall.

A pocket can be disposed within the compressible bladder, such as in an interior portion thereof, for receiving and retaining an article, such as a packet of energy gel or the like. The pocket can have an open inner volume that is fluidically sealed in relation to the open inner volume of the compressible bladder but that is in thermal communication therewith. Embodiments of the drinking vessel can further include an aeration cap with a plurality of aeration apertures therein and a means for selectively retaining the aeration cap in relation to the outlet member. With such an aeration cap, a cooling spray of liquid can be created by a compressing of the compressible bladder. Further cooling and comfort can be enjoyed by a user through the provision of a sponge that can be coupled, for example, to the compressible bladder.

In particular constructions of the drinking vessel, a means can be incorporated for selectively retaining the compressible bladder in a retracted configuration adjacent to a wrist of a user. In one example, that means can take the form of a wrist engaging member, such as a wristband, in combination with a strap coupled to the compressible bladder and to the wrist engaging member. The strap can be flexible and spring-loaded to a coiled configuration such that the compressible bladder can be selectively retained adjacent to a wrist of a user by a coiling of the strap. Alternatively, the strap can be slidably engaged with the wrist engaging member so that the compressible bladder can be selectively retained adjacent to a wrist of a user by a sliding of the strap in relation to the wrist engaging member. Particularly where such a strap is provided, a means can be provided for retaining textual information relative to the drinking vessel so that a user can retain desired information, such as a pace chart, emergency information, or any other type of information.

The handheld drinking vessel may be used to practice a hydration method by first providing a handheld drinking vessel as described. The handheld drinking vessel can then be disposed in a hand of a person, and the inlet member can be inserted directly into a volume of liquid, such as a volume of liquid in a beverage cup procured by an athlete from a water stop provided by an organizer during a road race. With the inlet member so disposed, the compressible bladder can be decompressed to draw liquid from the volume of liquid and into the compressible bladder through the inlet member. Where necessary, the compressible bladder can be at least partially compressed prior to the step of decompressing the compressible bladder. Then, the liquid drawn into the open inner volume of the compressible bladder can be drunk by the athlete through the outlet member to provide hydration.

Furthermore, hydration can be provided to athletes during an athletic endeavor, such as by a race organizer during a road race by providing each of at least some of the athletes with a handheld drinking vessel as disclosed herein and providing at least one water stop with a plurality of beverage containers wherein each beverage container retains a volume of liquid for being consumed by the athletes. With that, each athlete with a handheld drinking vessel can receive hydration by disposing the handheld drinking vessel in a hand of the athlete, procuring a beverage container with a volume of liquid from the water stop, inserting the inlet member into the volume of liquid in the beverage container, decompressing the compressible bladder to draw liquid from the volume of liquid in the beverage container into the compressible bladder through the inlet member, and drinking liquid from the open inner volume of the compressible bladder through the outlet member.

In certain practices of the invention, each handheld drinking vessel can be distributed with an initial volume of liquid retained in the open inner volume of the compressible bladder and with a means for capping the outlet member. In one example, the initial volume of liquid can be a beverage of a purveyor of beverages for being initially consumed by the athlete prior to the drinking vessel being refilled at a water stop. Particularly where they are provided by a sponsor, the handheld drinking vessels could be distributed to the athletes on a complimentary basis. In such a practice of the invention, the compressible bladder could be at least partially formed from a thin film material so the drinking vessels could be disposable.

One will appreciate that the foregoing discussion broadly outlines the more important features of the invention to enable a better understanding of the detailed description that follows and to instill a better appreciation of the inventor's contribution to the art. Before any particular embodiment or aspect thereof is explained in detail, it must be made clear that the following details of construction and illustrations of inventive concepts are mere examples of the many possible manifestations of the invention.

DETAILED DESCRIPTION OF PREFERRED EMBODIMENTS

Figure 1:
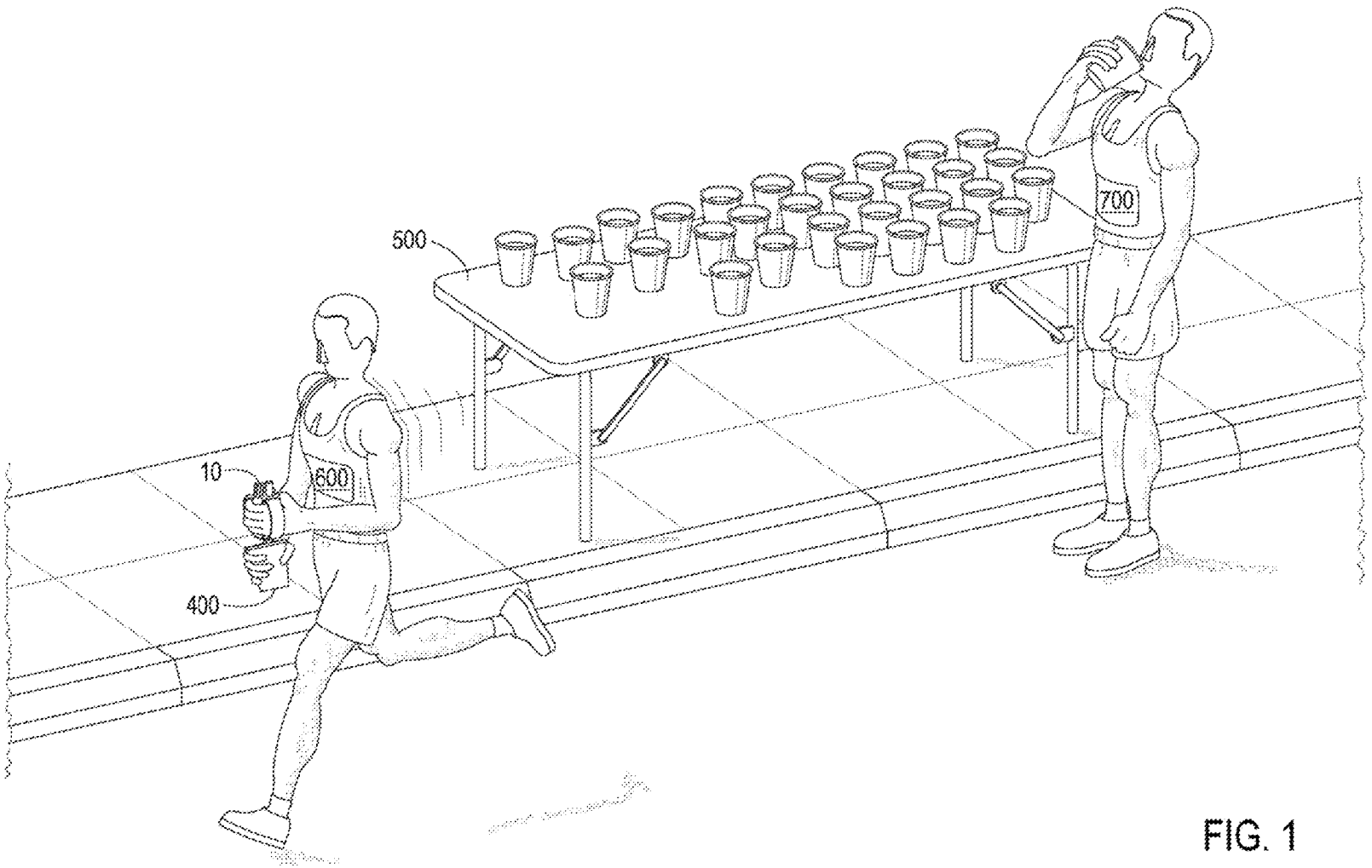
FIG. 1 is a perspective view of a road race water stop with a first runner employing a replenishable drinking vessel according to the present invention and a second runner drinking directly from a beverage cup.

The replenishable drinking vessel and the method for using the same to provide hydration to athletes are subject to a wide variety of embodiments. However, to ensure that one skilled in the art will be able to understand and, in appropriate cases, practice the present invention, certain preferred embodiments of the broader invention revealed herein are described below and shown in the accompanying drawing figures. Before any particular embodiment of the invention is explained in detail, it must be made clear that the following details of construction, descriptions of geometry, and illustrations of inventive concepts are mere examples of the many possible manifestations of the invention.

Looking more particularly to the drawings, a first preferred embodiment of the present invention for a replenishable drinking vessel is indicated generally at 10 in FIGS. 1 through 6. There, one can see that the drinking vessel 10 is founded on a compressible bladder 12 with an inlet member 14 for drawing liquid 200 into an open inner volume 26 of the compressible bladder 12 and an outlet member 16 for enabling an exhausting of liquid 200 from the open inner volume 26. The inlet member 14 in the present embodiment can be considered to project from a bottom of the compressible bladder 12, and the outlet member 16 can be considered to project from a top of the compressible bladder 12. In this exemplary structure, the inlet member 14 and the outlet member 16 each comprise a tube with a proximal portion coupled to the compressible bladder 12 and a free distal end.

Figure 10:
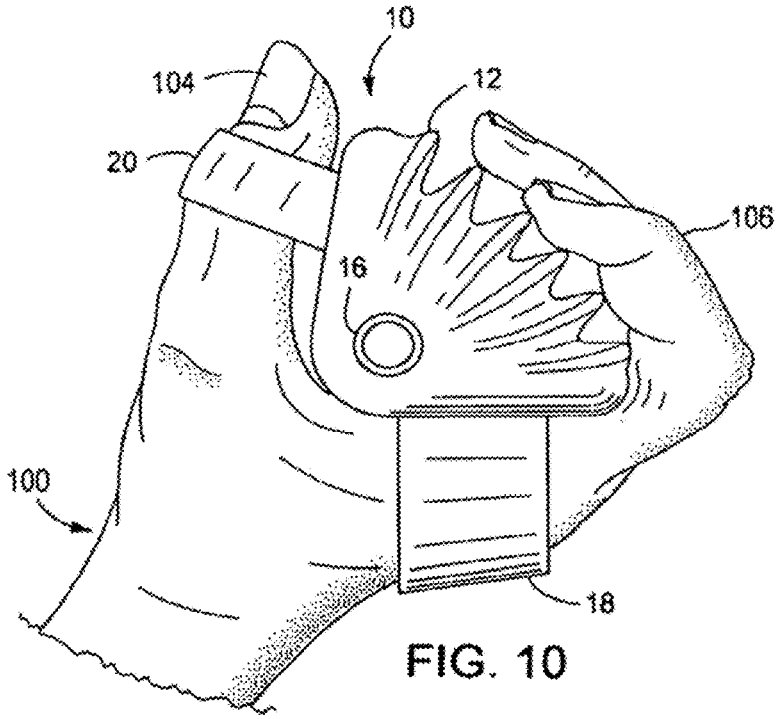
FIG. 10 is a top plan view of a further embodiment of a replenishable drinking vessel under to the present invention.

The drinking vessel 10 can be retained relative to a hand 100 of a user by a retaining means, which in this case comprises a first strap 18 and a second strap 20. The first strap 18 can encircle the palm portion 102 of the user's hand 100 while the second strap 20 can encircle one or more fingers 106. As the drinking vessel is employed in FIGS. 2 through 5, the second strap 20 encircles one or more forefingers 106. However, the second strap 20 could additionally or alternatively encircle the thumb 104 as is depicted, by way of example, in FIG. 10. Of course, other retaining means are possible and well within the scope of the invention.

Figure 6:
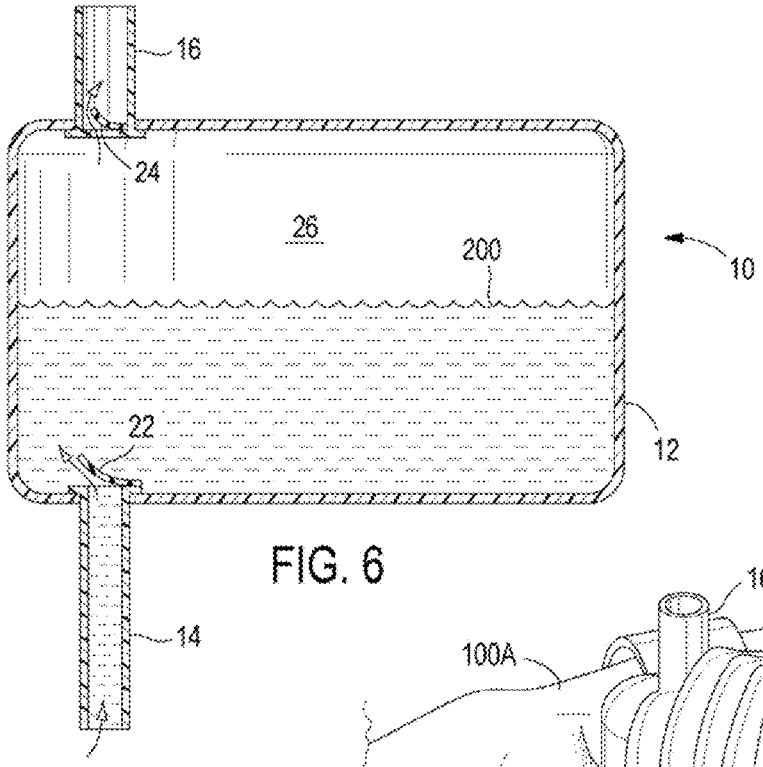
FIG. 6 is a cross sectional view in front elevation of the replenishable drinking vessel of FIG. 2 in a non-compressed configuration.
Figure 9:
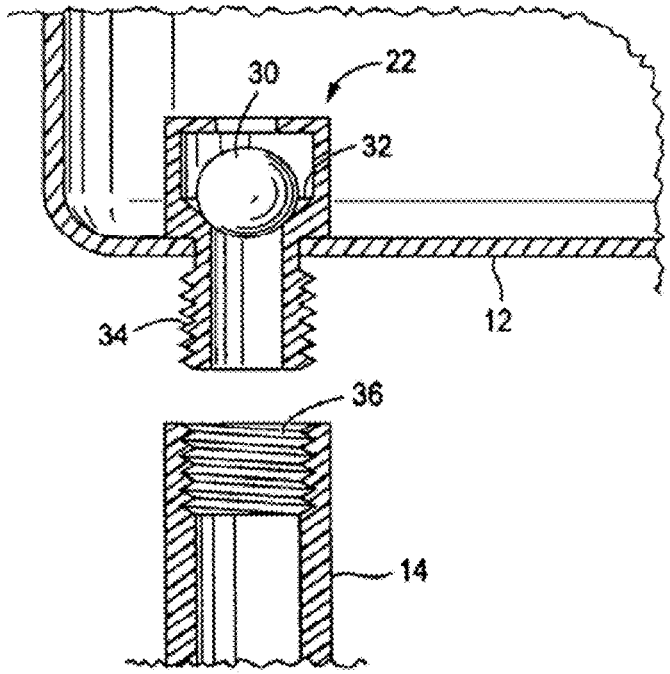
FIG. 9 is a cross sectional view in front elevation of a portion of another alternative embodiment of a replenishable drinking vessel pursuant to the present invention.

As shown in FIG. 6, an inlet valve arrangement 22, which can comprise a one-way valve, can be fluidically associated with the inlet member 14. Additionally, an outlet valve arrangement 24, which can also comprise a one-way valve, can be fluidically associated with the outlet member 16. The inlet and outlet valve arrangements 22 and 24 could be similar or different in structure and function. In the illustrated example, the inlet and outlet valve arrangements 22 and 24 each comprise simple one-way, flapper-type valves. However, the inlet valve arrangement 22 and, additionally or alternatively, the outlet valve arrangement 24 could alternatively comprise ball check valves as shown in FIG. 9, opposed lip valves, or any other type of valve that might now exist or hereafter be developed.

Figure 6A:
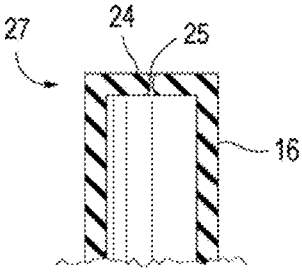
FIG. 6A is a cross sectional view in front elevation of an alternative outlet valve arrangement.

In an alternative example, the outlet valve arrangement 24 could comprise a selectively operable valve arrangement, such as what is commonly termed a bite valve. A bite valve can enable an actuation of the valve arrangement 24 by a compression thereof by the mouth of the user to permit a withdrawing of liquid 200 from within the open inner volume 26 of the compressible bladder 12. One of the many possible examples of such an embodiment of the outlet valve arrangement 24 is shown in FIG. 6A where a slit 25 is disposed in an end cap portion 27 of the outlet member 16. With this, a user could simply bite on the end cap portion 27 of the outlet member 16 thereby to induce the normally closed slit 25 to an open configuration to allow liquid to pass therethrough.

Figure 3:
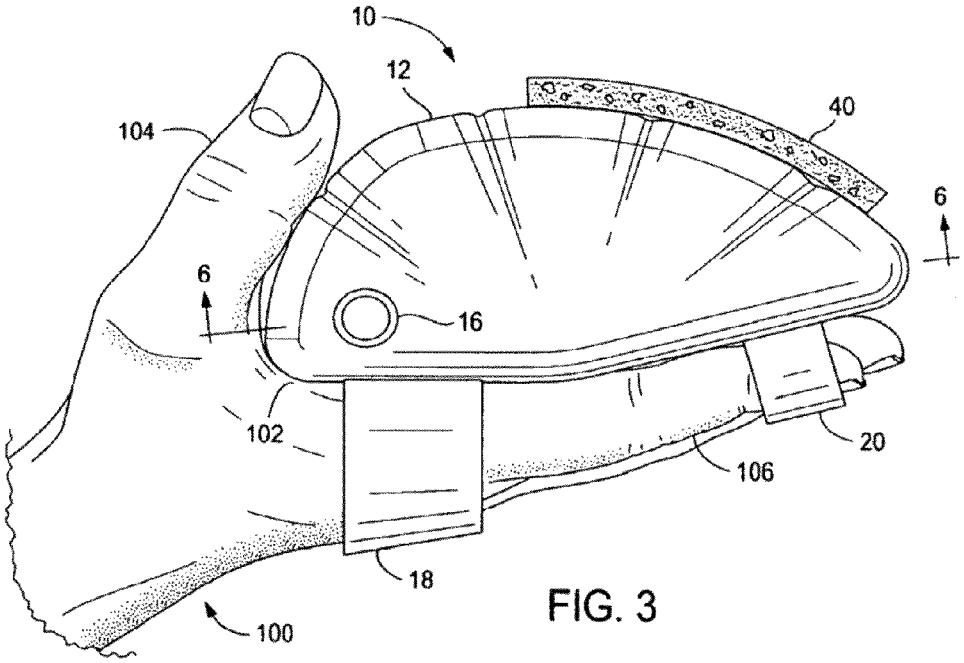
FIG. 3 is a top plan view of the replenishable drinking vessel of FIG. 2 again retained relative to a hand of a user in a non-compressed configuration.

As is depicted in FIG. 3, certain embodiments of the drinking vessel 10 can additionally incorporate a sponge element 40. With this, a user can soak the sponge element 40 with water and use the same to clean and cool his or her body while exercising. The sponge element 40 can be retained relative to substantially any component or portion of the drinking vessel 10. In FIG. 3, the sponge element 40 is fixed to the bladder 12. The sponge element 40 can be permanently attached to the remainder of the drinking vessel 10. Alternatively, the sponge element 40 can be removably attached, such as by a hook and loop combination or any other suitable means.

As will be described more fully below, the drinking vessel 10 could initially be provided in an empty condition to be filled by the user. Alternatively, the drinking vessel 10 could be provided to users with an initial volume of liquid 200 retained in the open inner volume 26. In either case, the open inner volume 26 can be readily filled and refilled with liquid 200 simply by at least partially compressing the bladder 12 to an at least partially compressed configuration as is shown, for example, in FIG. 4, directly disposing the inlet member 14 at least partially into a volume of liquid 200, and decompressing the bladder 12 to an open, non-compressed configuration as is shown, for example, in FIGS. 2 and 3.

Figure 2:
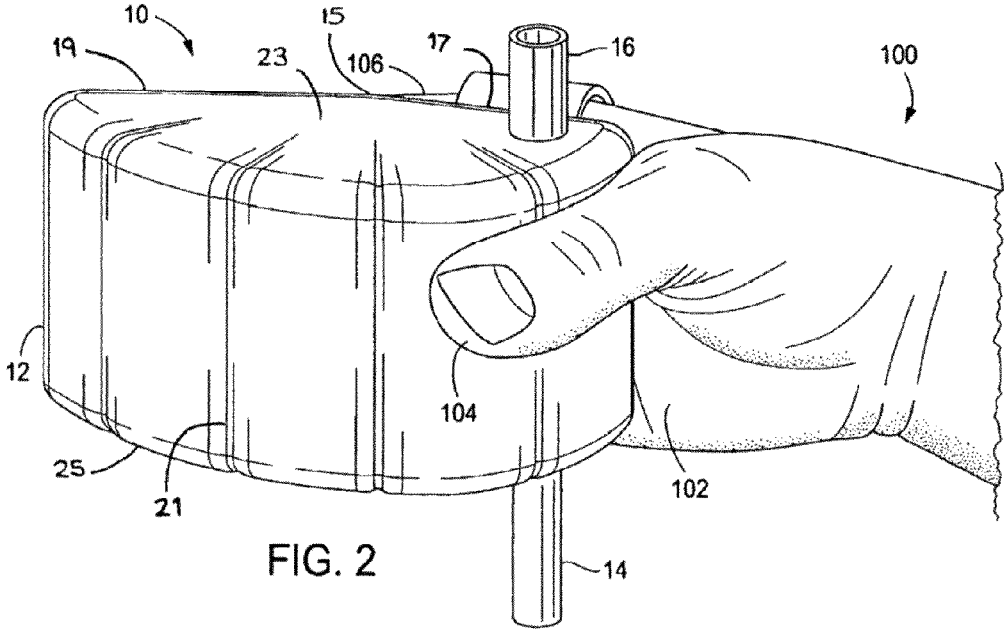
FIG. 2 is a perspective view of a replenishable drinking vessel according to the present invention retained in a non-compressed configuration relative to a hand of a user.
Figure 4:
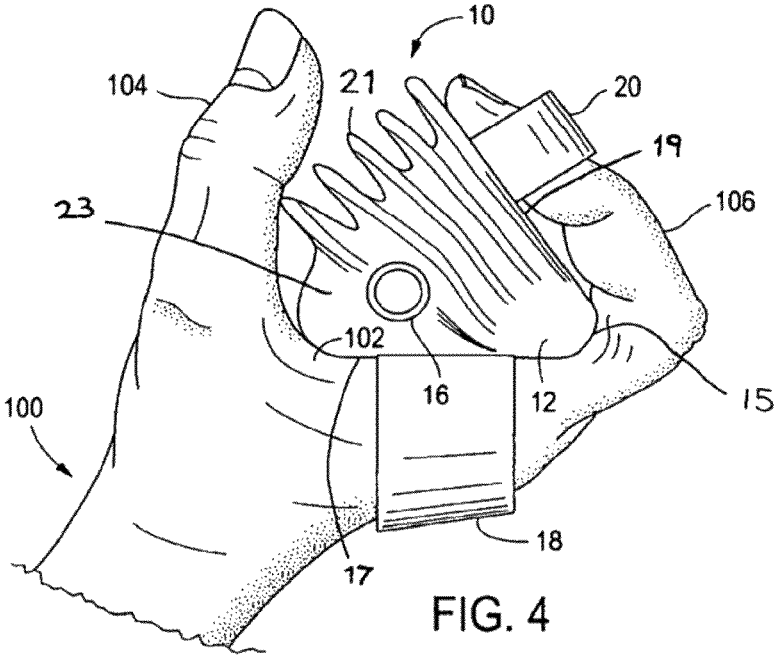
FIG. 4 is a top plan view of the replenishable drinking vessel of FIG. 2 retained relative to a hand of a user in a partially compressed configuration.
Figure 5:
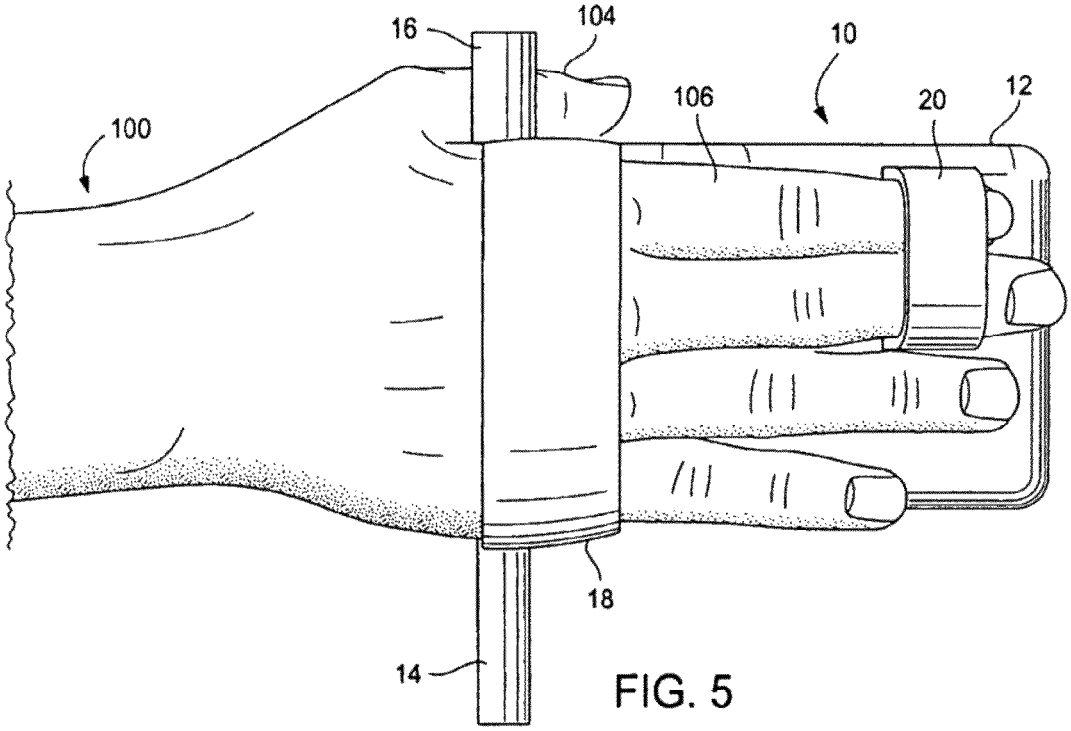
FIG. 5 is a view in rear elevation of the replenishable drinking vessel of FIG. 2 retained relative to a hand of a user in a non-compressed configuration.

The compressible bladder 12 could certainly pursue many constructions within the scope of the invention. With reference to FIGS. 2 and 4, one presently contemplated compressible bladder 12 can be seen to have first and second side walls 17 and 19 and a compression wall 21 that bridges between distal portions of the first and second side walls 17 and 19. The first and second side walls 17 and 19 can be considered to meet at proximal portions thereof at an effective axis 15 about which each side wall 17 and 19 can generally pivot as the compressible bladder 12 is compressed or decompressed. It will be appreciated, of course, that the first and second side walls 17 and 19 may not pivot about precisely the same location and that the effective axis 15 is meant to describe a general area about which the first and second side walls 17 and 19 can be considered to pivot. As is shown in FIG. 4, as the drinking vessel 10 is compressed, the compression wall 21, the top wall 23, and the bottom wall 25 of the compressible bladder 12 collapse and pleats or folds are formed therein.

Figure 13:
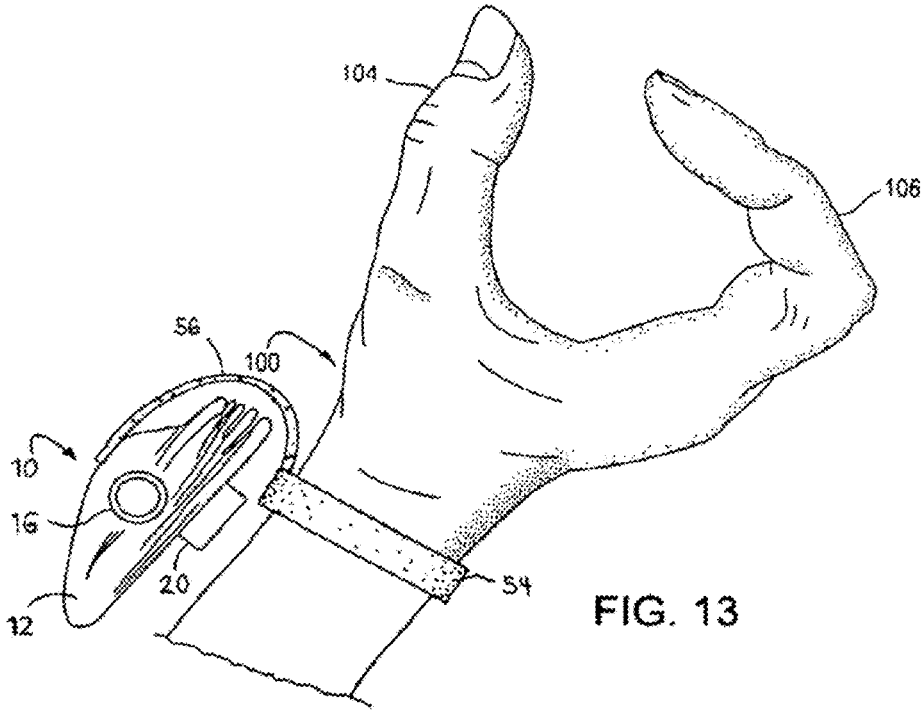
FIG. 13 is a top plan view of the replenishable drinking vessel of FIG. 12 retained relative to a hand of a user in a retracted configuration.

The first and side walls 17 and 19, which can be flexible or inflexible, can be pivoted about the axis 15 to a fully compressed configuration as in FIG. 13 even beyond the partially compressed configuration shown, for example, in FIG. 4 to allow the drinking vessel 10 to achieve a substantially flat arrangement. With this, the drinking vessel 10 can be readily retained and stored in a compact configuration. Under such an arrangement, the drinking vessel 10 can be retained with the axis 15 disposed, for example, between a user's forefingers 106 and palm 102 or between the user's thumb 104 and palm 102 to enable an effective and comfortable compression and decompression of the compressible bladder 12.

Figure 11:
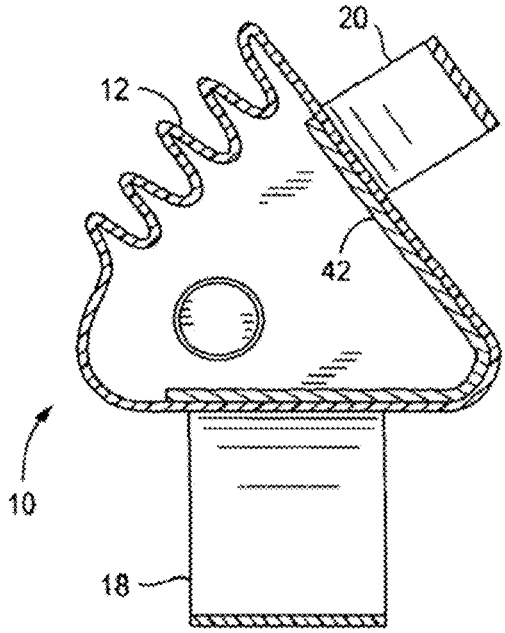
FIG. 11 is a sectioned top plan view of another embodiment of a drinking vessel according to the present invention.

As FIG. 11 shows, the bladder 12 could incorporate a skeleton structure 42 for assisting the drinking vessel 10 in maintaining its overall shape and rendering the first and second side walls 17 and 19 partially or completely inflexible. Where included, such a skeleton structure 42 could pursue a variety of constructions. In the depicted embodiment, the skeleton structure 42 is generally V shaped when in a decompressed configuration. The skeleton structure 42 can be compressed to a configuration with the legs of the V pivoted into proximity with one another. In certain cases, the skeleton structure 12 could be spring loaded to bias the bladder to a given condition, such as to a compressed condition or to a decompressed condition. The skeleton structure 12 could be formed from any suitable material including, for example, spring metal or plastic.

It will be appreciated, of course, that the bladder 12 could be compressed before, after, and/or while inlet member 14 is inserted directly into the volume of liquid 200. In any case, as the bladder 12 is decompressed, liquid 200 will be drawn into the open inner volume 26 through the inlet member 14. This intake of liquid 200 will be facilitated by the combined effects of the inlet valve arrangement 22, which will allow liquid to pass into the open inner volume 26, and the outlet valve arrangement 24, which will close to induce a sufficient pressure differential between the open inner volume 26 and the environment.

Figure 7:
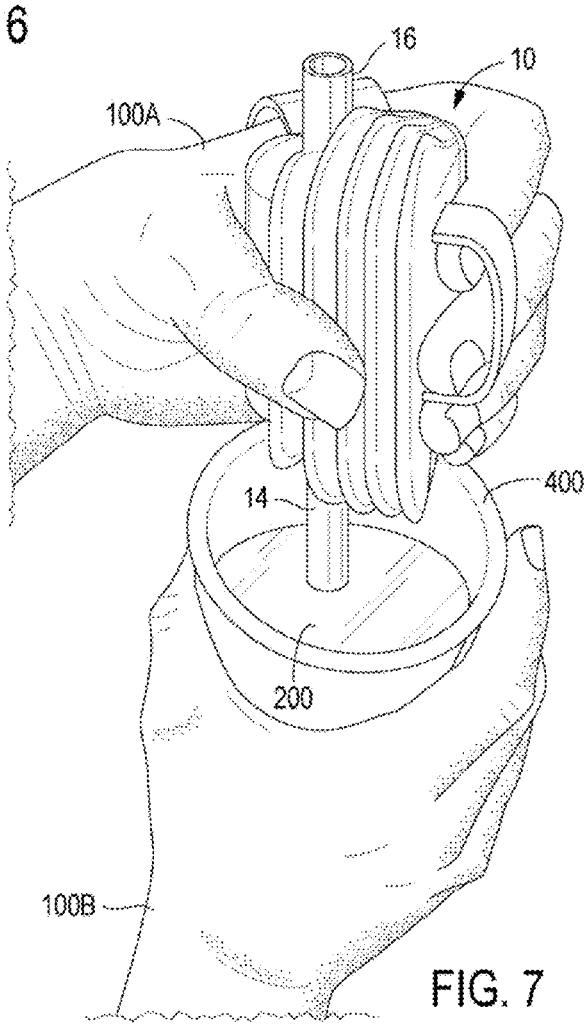
FIG. 7 is a perspective view of an embodiment of the replenishable drinking vessel during a refilling operation.

Advantageously, this filling of the open inner volume 26 can be carried out under substantially any conditions. By way of example, a runner participating in a road race can fill or refill the open inner volume 26 of the drinking vessel 10 with substantially no hindrance to the runner's race progress. As one can perceive from FIG. 1 and, in a closer depiction, FIG. 7, a runner 600 retaining an embodiment of the drinking vessel 10 relative to a first hand 100A can grab a cup 400 containing a volume of liquid 200, such as water or an energy drink, with his or her second hand 100B from a table 500 at a water stop. The runner 600 can then insert the inlet member 14 into the cup 400 and draw the liquid 200 into the open inner volume 26 by decompressing the bladder 12. The runner 600 can then discard the cup 400 while having a volume of liquid 200 now readily accessible.

With the volume of liquid 200 retained in the open inner volume 26, the runner 600 can drink liquid 200 from within the open inner volume 26 through the outlet member 16 by squeezing the bladder 12 and, additionally or alternatively, by creating suction with his or her mouth. Advantageously, the runner 600 can drink the liquid at his or her own pace, whether immediately or over a given distance, without a risk of choking, spilling, or any of the other notable disadvantages attributable to the prior art. In certain embodiments of the invention, a clip or the like (not shown) could be provided on the drinking vessel 10 to enable the drinking vessel 10 to be retained relative to a user's clothing or the like when not in use.

Figure 8:
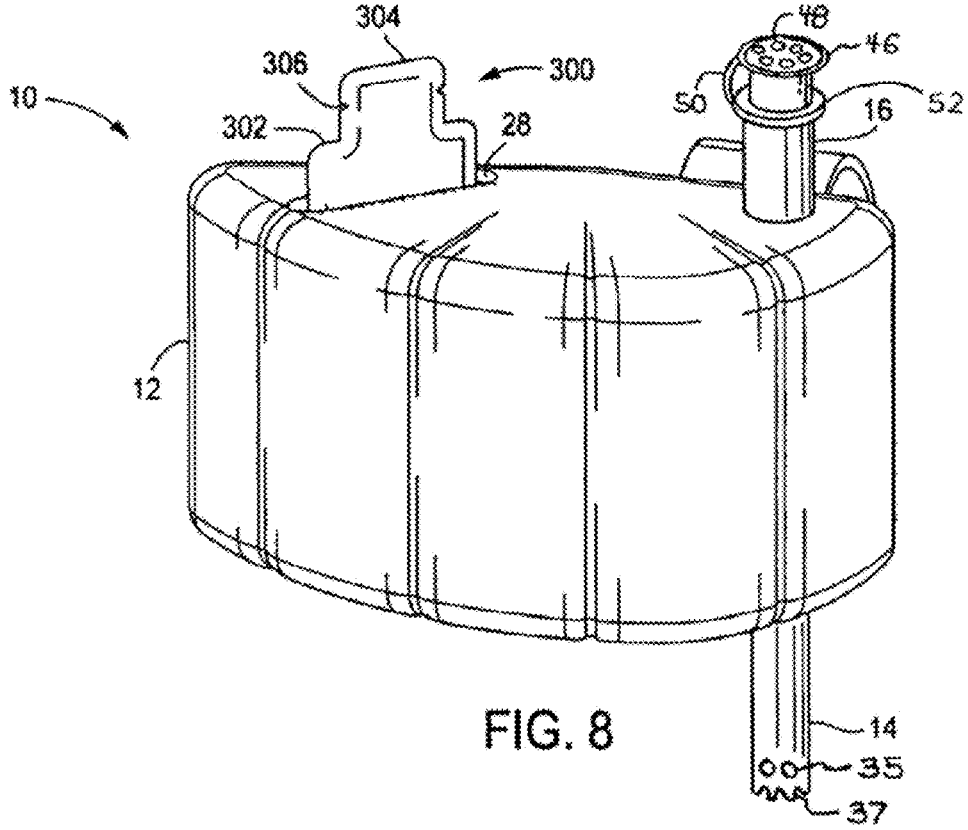
FIG. 8 is a perspective view of an alternative embodiment of the replenishable drinking vessel in a non-compressed configuration.

Of course, the invention is far broader than the embodiments described above. For example, a further variation is depicted in FIG. 8. There, the drinking vessel 10 again has a bladder 12 for retaining a volume of water, an inlet member 14 for enabling a drawing of liquid 200 into an open inner volume 26 of the bladder 12, and an outlet member 16 for enabling a user to drink liquid from the drinking vessel 10. In this embodiment, however, the drinking vessel 10 incorporates a pocket 28. The pocket 28 can be disposed in a central portion of the bladder 12 such that it would be surrounded by liquid 200 retained within the open inner volume 26. Alternatively, the pocket 28 can simply be disposed within or adjacent to a sidewall of the bladder 12.

The pocket 28 can be particularly sized and employed for receiving and retaining a packet 300 of any one of the many types of energy gels and supplements that are available to endurance athletes. Advantageously, where the pocket 28 is provided with thin walls, the liquid 200 and the packet 300 can be maintained in substantially direct thermal contact. With this, not only can an energy supplement packet 300 be readily retained relative to the drinking vessel 10, but also the energy supplement packet 300 and the volume of liquid 200 can assist in maintaining one another in a desired temperature condition. For example, under one use of the invention, a frozen packet 300 of supplement material can be inserted into the pocket 28 such that the liquid 200 and the packet 300 will cooperate to maintain both volumes in a cool temperature condition. When the runner seeks to consume the contents of the packet 300, the packet 300 can be slipped from within the pocket 28 and a tab 304 can be separated from a body portion 302 by use of perforations, a notch 306, or any other suitable means.

FIG. 8 also shows a further potential modification to drinking vessels 10 under the present invention in the form of an aeration cap 46. The aeration cap 46, which has a plurality of aeration apertures 48 therein, can be selectively coupled to the distal end of the outlet member 16, such as by a frictional engagement, a snap fit, or any other engagement means. The aeration apertures 48 could simply comprise holes in the aeration cap 46. Alternatively, the aeration apertures 48 could be formed in a sponge or other aeration means forming a portion of the aeration cap 46.

The aeration cap 46 can be retained relative to the remainder of the drinking vessel 10 by a tether 50 that has a distal end coupled to the aeration cap 46 and a proximal end coupled to the remainder of the drinking vessel 10, such as by a retaining ring 52 that surrounds the outlet member 16. Alternatively, the tether 50 could be coupled directly to the outlet member 16, the bladder 12, or any other portion of the drinking vessel 10. The aeration cap 48, the tether 50, and the retaining ring 52 could be formed unitarily, such as by molding, or as individual members and coupled by any suitable method. With such an aeration cap 46 in place, a runner can create a cooling spray or mist of water from the aeration apertures 48 simply by squeezing the bladder 12 and forcing water through the outlet member 16 and the aeration apertures 48.

FIG. 8 additionally shows that the distal end of the inlet member 14 could have at least one anti-plugging variation adjacent to the distal tip thereof. The anti-plugging variation could, for example, comprise a plurality of apertures 35 and, additionally or alternatively, a plurality of surface variations 37 at the tip of the inlet member 14. Such apertures 35 or surface variations 37 could advantageously prevent a cessation or limiting of fluid flow as might occur, for example, where a flat tip of the inlet member 14 engages a bottom of a cup (not shown in FIG. 8) or other source of liquid.

Looking to FIG. 9, a variation of the inlet portion of the drinking vessel 10 is shown. There, the inlet valve arrangement 22 takes the form of a ball check valve wherein a ball 30 is retained relative to a ball seat 32. With this, the inlet valve arrangement 22 can prevent the passage of liquid when the ball 30 is seated relative to the ball seat 32 but can allow the passage of liquid by a displacement of the ball 30. The embodiment of FIG. 9 additionally varies in that the inlet member 14 is removable and replaceable relative to the bladder 12 by a threaded member 34 retained relative to the bladder 12 in combination with a threaded portion 36 on the inlet member 14. With this, the drinking vessel 10 can be employed without the inlet member 14 by a selective removal thereof as might be desirable where the user expects to use the drinking vessel 10 without replenishing its contents or where the user might seek to refill the open inner volume 26 by placing the bottom of the bladder 12 directly into a volume of liquid.

Figure 12:
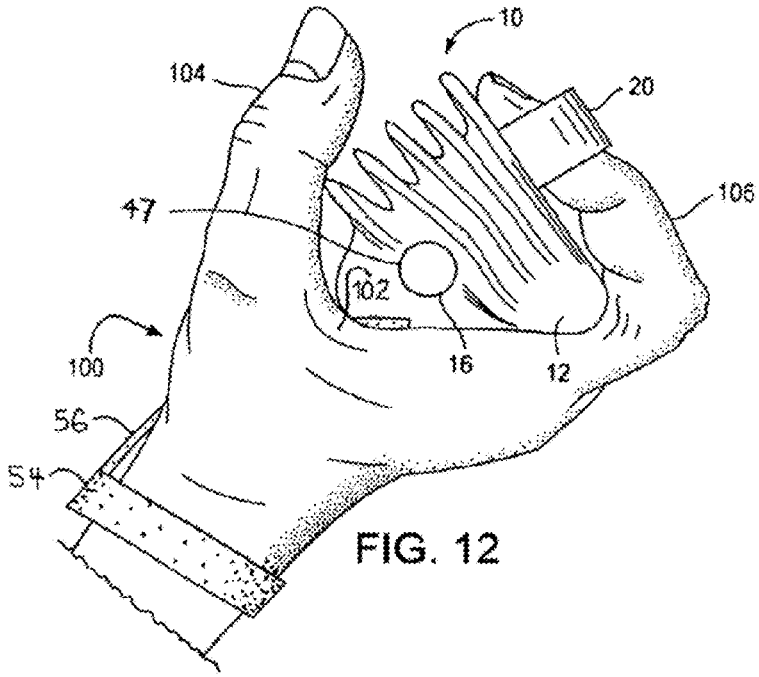
FIG. 12 is a top plan view of another variation of the present invention for a replenishable drinking vessel retained relative to a hand of a user in a use configuration.
Figure 14:
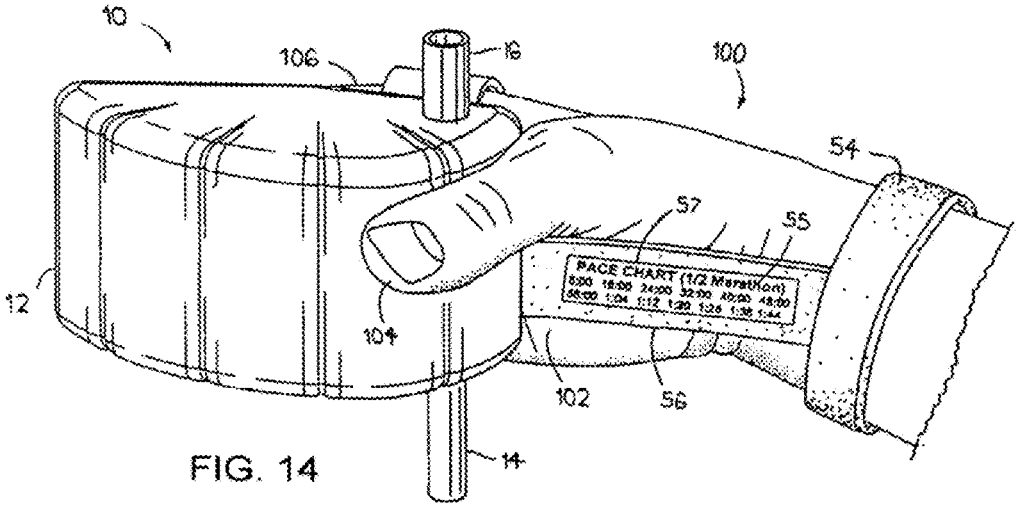
FIG. 14 is a perspective view of the replenishable drinking vessel of FIG. 12 in a use configuration again retained relative to a hand of a user.
Figure 15:
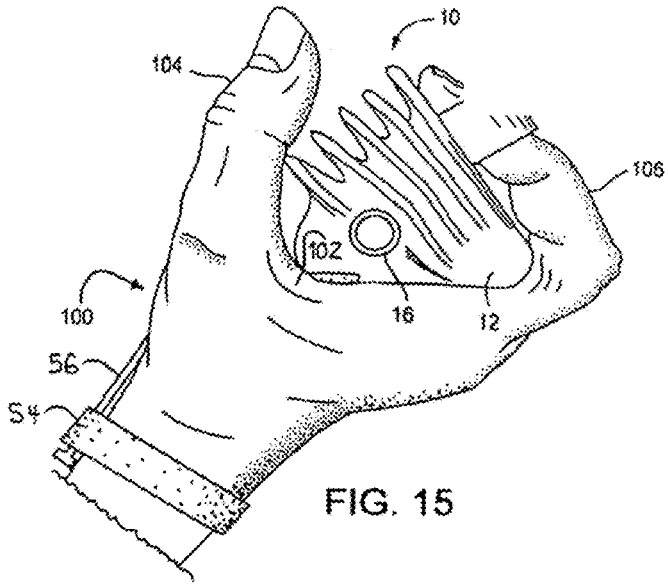
FIG. 15 is a top plan view of yet another variation of the present invention for a replenishable drinking vessel retained relative to a hand of a user in a use configuration.

As FIGS. 12 through 15 show, embodiments of the drinking vessel 10 are contemplated wherein a means is provided for selectively retaining the drinking vessel 10 in a use configuration as in FIGS. 12 and 14 or in a retracted configuration as shown in FIGS. 13 and 15. In the embodiment of FIGS. 12 through 14, the bladder 12 of the drinking vessel 10 is retained relative to a wristband 54 by a flexible strap 56. In certain cases, the strap 56 can be spring-loaded to a coiled configuration, such as is commonly the case with personal audio armbands, whereby the bladder 12 can be biased to the retracted configuration adjacent to the user's wrist as is depicted in FIG. 13 for comfortable storage during periods of non-use of the drinking vessel 10. The strap 56 can be readily uncoiled to achieve the use configuration of FIGS. 12 and 14. In such an embodiment, only the second strap 20 can be provided for engaging the user's forefingers 106. The first strap 18 can be dispensed with as the strap 56 could provide satisfactory retention and stabilization of the bladder 12.

As FIG. 14 also shows, the strap 56 can be employed for retaining textual information 55, which can be visible to the user when the drinking vessel 10 is in a use configuration. In some cases, for example, the strap 56 can be used for retaining a removable and replaceable panel 57 with textual information 55 thereon. With this, a runner could retain, by way of example, a pace chart for guiding the runner as to desired time goals per unit distance or the like.

Other means for retaining the bladder 12 between use and storage configurations would readily occur to one skilled in the art after reading the present disclosure. Each such means is within the scope of the present invention. For example, in the embodiment of FIG. 15, the bladder 12 of the drinking vessel 10 can be reconfigured between use and refracted configurations by a strap 56 that has a body portion that is slidably engaged with a wristband 54. The strap 56 can be rigid or flexible. With this, the strap 56 could be slid between an extended disposition wherein the bladder 12 is retained in the user's hand 100 and a retracted disposition wherein the bladder 12 is retained adjacent to the user's wrist as in FIG. 15.

Material selection in relation to the drinking vessel 10 can have great import relative to its nature and purpose. In certain embodiments, the bladder 12 can be formed from a thin film. One skilled in the art will be aware of a number of possible thin films that could be employed. Furthermore, suitable thin films may be developed subsequent to the preparation of the present disclosure. All such thin films should be considered to be within the scope of the invention.

Among the presently contemplated thin films are polyester films; polyimide films; metal foils, which could be lined with one or more plies of polymeric material for strength and durability; polypropylene films; multi-ply films; or any other suitable thin films. Films such as those commonly sold under the marks MYLAR, HOSTAPHAN, PROLENE, and KAPTON could potentially be used. In certain embodiments, the thickness of the thin film could range, for example, from 0.00010 inches (10 mil) to 0.00050 inches (50 mil). MYLAR and HOSTAPHAN thin films could preferably be incorporated in thicknesses ranging from 0.00010 inches (10 mil) to 0.00024 inches (24 mil). Other components of the drinking vessel 10, such as the first and second straps 18 and 20 and other portions of the drinking vessel 10, could be formed from similar or different materials. The inlet and outlet members 14 and 16 in such a construction can be formed of simple straw-like members of plastic or the like.

It will be appreciated that such embodiments of the drinking vessel 10 could likely be manufactured at relatively little expense such that they could be designed to be essentially disposable, such as after a single race or use or after a limited number of races or other uses. Under such a construction, it could be practicable for a race organizer or one or more race sponsors to provide some or all runners in a road race with a complimentary drinking vessel 10 to be used during the race. The drinking vessel 10 could be provided in an empty condition to be filled prior to or during the race. Alternatively, such as where the sponsor is a purveyor of beverages, drinking vessels 10 can be distributed pre-filled with the race sponsor's beverage, possibly while bearing the sponsor's trademark or the like.

As is shown in FIG. 12, where the drinking vessel 10 is provided in a pre-filled condition, a cap 47 can be removably disposed at the distal tip of the outlet member 16 to prevent an unintended exhausting of liquid from the compressible bladder 12. The cap 47 can be of any effective construction and can be retained in any suitable manner including, for example, a frictional fit, a snap engagement, a perforated tear-away construction, or any other means.

Whether designed to be disposable or not, such thin film drinking vessels 10 are particularly advantageous for the further reason that they can be made extremely light in weight, which is, of course, quite important to a runner. Indeed, with a compressible bladder 12 and possibly first and second straps 18 and 20 formed of thin film material, an empty drinking vessel 10 would be nearly weightless in a runner's hand and, therefore, would present substantially no impediment during running or other exercise.

Alternative constructions of the drinking vessel 10 can be crafted to enable repeated usage such that a runner or other user can use the drinking vessel 10 during multiple training runs, races, and further situations where replenishable liquid refreshment would be desirable. Such a drinking vessel 10 can, by way of example, have a compressible bladder 12 formed from one or more layers of polymeric material, such as rubber, from a fabric material, or any other material or combination of layers or types of material that is durable and liquid tight. The inlet and outlet members 14 and 16 in such an embodiment can be rigid or flexible tubes of, for example, rubber, plastic, or any other suitable material.

From the foregoing, it will be clear that the present invention has been shown and described with reference to certain preferred embodiments that merely exemplify the broader invention revealed herein. Certainly those skilled in the art can conceive of alternative embodiments. For instance, those with the major features of the invention in mind could craft embodiments that incorporate those major features while not incorporating all of the features included in the preferred embodiments.

With the foregoing in mind, the following claims are intended to define the scope of protection to be afforded the inventor, and the claims shall be deemed to include equivalent constructions insofar as they do not depart from the spirit and scope of the present invention. A plurality of the following claims may express certain elements as a means for performing a specific function, at times without the recital of structure or material. As the law demands, these claims shall be construed to cover not only the corresponding structure and material expressly described in this specification but also equivalents thereof.

I claim as deserving the protection of United States Letters Patent:

1. A hydration method employing a handheld drinking vessel, the method comprising the following steps:

providing a handheld drinking vessel comprising:

a compressible bladder for being received within a hand of a user wherein the compressible bladder has an open inner volume for retaining a volume of liquid and wherein the compressible bladder is compressible between a non-compressed configuration and a compressed configuration;

an inlet member with a fluid flow path, a proximal end in fluidic association with the compressible bladder, and a distal portion;

an outlet member with a fluid flow path, a proximal end in fluidic association with the compressible bladder, and a distal portion;

an inlet valve arrangement in fluidic association with the inlet member wherein the inlet valve arrangement is configured to permit a flow of liquid into the compressible bladder through the fluid flow path of the inlet member; and an outlet valve arrangement in fluidic association with the outlet member wherein the outlet valve arrangement is configured to permit a flow of liquid from the compressible bladder through the fluid flow path of the outlet member;

disposing the handheld drinking vessel in a hand of a person participating in an athletic endeavor;

procuring a beverage container with a volume of liquid retained therein wherein the beverage container comprises a cup procured by an athlete from a water stop provided by an organizer of the athletic endeavor;

inserting the inlet member into the volume of liquid;

decompressing the compressible bladder to draw liquid from the volume of liquid into the compressible bladder through the inlet member whereby a volume of liquid is then contained in the compressible bladder of the handheld drinking vessel and in the hand of the person; and retaining the compressible bladder and the volume of liquid drawn from the beverage container during participation in the athletic endeavor and drinking liquid that was drawn from the beverage container from the open inner volume of the compressible bladder through the outlet member at a pace selected by the athlete.

2. The hydration method of claim 1 further comprising the step of at least partially compressing the compressible bladder prior to the step of decompressing the compressible bladder.

3. The hydration method of claim 1 wherein the beverage container is a cup procured by an athlete from a water stop during a road race.

4. The hydration method of claim 1 wherein the drinking vessel is distributed with an initial volume of liquid retained in the open inner volume of the compressible bladder and with a means for capping the outlet member.

5. The hydration method of claim 1 wherein the inlet valve arrangement and the outlet valve arrangement each comprises a one-way valve and wherein the compressible bladder has an upper portion and a lower portion disposed opposite to the upper portion, wherein the outlet member projects from the upper portion and the inlet member projects from the lower portion, and wherein the inlet and outlet members each comprises a tubular member.

6. The hydration method of claim 1 further comprising a pocket disposed within the compressible bladder wherein the pocket has an open inner volume fluidically sealed in relation to the open inner volume of the compressible bladder and wherein the open inner volume of the pocket is in thermal communication with the open inner volume of the compressible bladder and further comprising the step of inserting an energy supplement packet into the pocket.

7. The hydration method of claim 1 wherein the drinking vessel further comprises a means for selectively retaining the compressible bladder in a retracted configuration adjacent to a wrist of a user and further comprising the step of disposing the compressible bladder in a retracted configuration.

8. The hydration method of claim 1 wherein the compressible bladder is at least partially formed from a thin film material.

9. The hydration method of claim 1 wherein at least the step of drinking liquid from the open inner volume of the compressible bladder through the outlet member is carried out during an athletic endeavor.

10. The hydration method of claim 1 further comprising a means for enabling an exertion of an expansion force on the compressible bladder and wherein the step of decompressing the compressible bladder comprises drawing the compressible bladder toward a non-compressed configuration by hand actuation.

11. The hydration method of claim 10 wherein the means for enabling an exertion of an expansion force comprises at least one strap with first and second ends coupled to the compressible bladder and a body portion and wherein the step of decompressing the compressible bladder further comprises inserting at least one finger of the person under the strap.

12. A method for providing hydration to athletes during an athletic endeavor, the method comprising the following steps:

providing each of a plurality of the athletes with a handheld drinking vessel, each handheld drinking vessel comprising:

a compressible bladder for being received within a hand of a user wherein the compressible bladder has an open inner volume for retaining a volume of liquid and wherein the compressible bladder is compressible between a non-compressed configuration and a compressed configuration;

an inlet member with a fluid flow path, a proximal end in fluidic association with the compressible bladder, and a distal portion;

an outlet member with a fluid flow path, a proximal end in fluidic association with the compressible bladder, and a distal portion;

an inlet valve arrangement in fluidic association with the inlet member wherein the inlet valve arrangement is configured to permit a flow of liquid into the compressible bladder through the fluid flow path of the inlet member; and an outlet valve arrangement in fluidic association with the outlet member wherein the outlet valve arrangement is configured to permit a flow of liquid from the compressible bladder through the fluid flow path of the outlet member;

providing at least one water stop with a plurality of beverage containers wherein each beverage container comprises a cup from a water stop provided by an organizer of the athletic endeavor and wherein the beverage container retains a volume of liquid for being consumed by the athletes;

whereby each athlete with a handheld drinking vessel can receive hydration by disposing the handheld drinking vessel in a hand of the athlete, procuring a beverage container with a volume of liquid from the water stop, inserting the inlet member into the volume of liquid in the beverage container, decompressing the compressible bladder to draw liquid from the volume of liquid in the beverage container into the compressible bladder through the inlet member whereby a volume of liquid is then contained in the compressible bladder of the handheld drinking vessel and in the hand of the person, and retaining the compressible bladder and the volume of liquid drawn from the beverage container during participation in the athletic endeavor and drinking liquid that was drawn from the beverage container from the open inner volume of the compressible bladder through the outlet member at a pace selected by the athlete.

13. The method for providing hydration of claim 12 wherein the inlet valve arrangement and the outlet valve arrangement each comprises a one-way valve and wherein the compressible bladder has an upper portion and a lower portion disposed opposite to the upper portion, wherein the outlet member projects from the upper portion and the inlet member projects from the lower portion, and wherein the inlet and outlet members each comprises a tubular member.

14. The method for providing hydration of claim 12 further comprising a means for enabling an exertion of an expansion force on the compressible bladder whereby each athlete can decompress the compressible bladder toward a non-compressed configuration by hand actuation.

15. The method for providing hydration of claim 12 wherein each handheld drinking vessel is distributed with an initial volume of liquid retained in the open inner volume of the compressible bladder and with a means for capping the outlet member.

16. The method for providing hydration of claim 15 wherein the compressible bladder is at least partially formed from a thin film material.

17. The method for providing hydration of claim 15 wherein the initial volume of liquid comprises a beverage of a purveyor of beverages.

18. The method for providing hydration of claim 17 wherein the handheld drinking vessels are distributed to the athletes on a complimentary basis.

* * * * *